United States Patent [19]

Brodbeck et al.

[11] Patent Number: 4,561,258

[45] Date of Patent: Dec. 31, 1985

[54] GRAVITY-FED LOW PRESSURE CRYOGENIC LIQUID DELIVERY SYSTEM

[75] Inventors: Howard D. Brodbeck, Berwyn; Martin A. Krongold, Aston, both of Pa.

[73] Assignee: MG Industries, Valley Forge, Pa.

[21] Appl. No.: 694,469

[22] Filed: Jan. 24, 1985

[51] Int. Cl.[4] ..... F17C 13/02

[52] U.S. Cl. ..... 62/49; 62/55; 137/436; 137/587; 137/592

[58] Field of Search ..... 62/49, 45; 137/434, 137/436, 587, 589, 592

[56] References Cited

U.S. PATENT DOCUMENTS

| | | | |
|---|---|---|---|
| 1,711,272 | 4/1929 | Lueders | 137/434 |
| 1,872,831 | 8/1932 | Siems | 62/55 |
| 3,097,498 | 7/1963 | Williams | 62/55 |
| 3,272,238 | 9/1966 | Groppe | 141/5 |
| 3,605,424 | 9/1971 | Paine | 62/51 |
| 3,803,858 | 4/1974 | Simon | 62/52 |
| 3,858,404 | 1/1975 | Davis | 62/51 |
| 3,938,347 | 2/1976 | Reidel | 137/392 |
| 4,059,424 | 11/1977 | Bentz | 62/49 |
| 4,192,147 | 3/1980 | Gilbert et al. | 62/49 |

*Primary Examiner*—Ronald C. Capossela
*Attorney, Agent, or Firm*—William H. Eilberg

[57] ABSTRACT

A system for delivering cryogenic liquids at controlled low pressures is disclosed, wherein the liquid is withdrawn from the bottom of a container, and allowed to flow by gravity to the point of use. The system comprises an inlet conduit which directs a liquid cryogen into the container. The inlet conduit is connected to a float valve assembly which regulates the height of the liquid in the container. The vertical position of the float valve assembly is adjustable. The liquid cryogen is withdrawn from the bottom of the container, through an insulated outlet conduit. The pressure of the output liquid is determined by the vertical distance between the lower end of the outlet conduit and the liquid level in the container. Adjustment of the position of the float valve assembly therefore controls the output pressure. Gas bubbles that may form in the liquid tend to rise to the top of the container, so that the output is of a single phase, that is, an essentially pure liquid.

12 Claims, 1 Drawing Figure

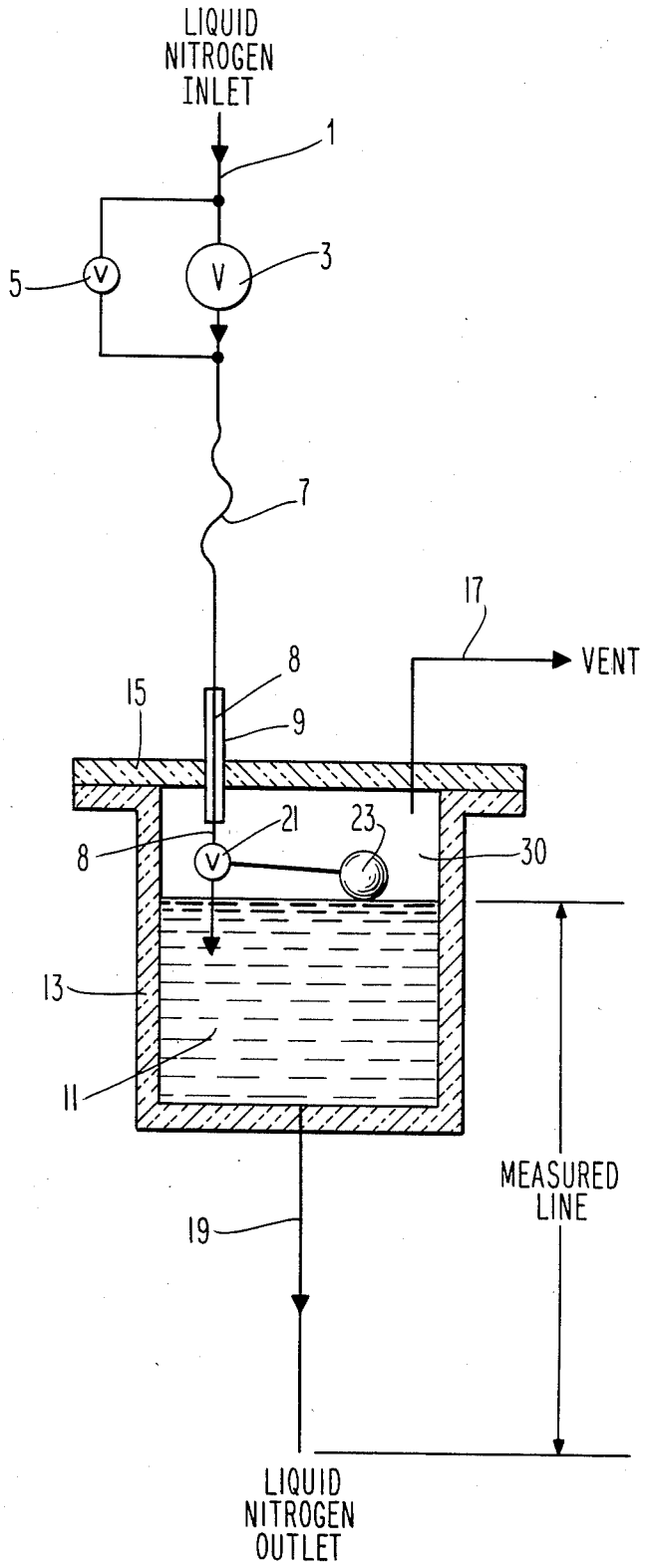
LIQUID
NITROGEN
INLET
1
5
V
V
3
7
17
VENT
8
9
15
21
23
8
V
30
13
11
MEASURED
LINE
19
LIQUID
NITROGEN
OUTLET

GRAVITY-FED LOW PRESSURE CRYOGENIC LIQUID DELIVERY SYSTEM

BACKGROUND OF THE INVENTION

The present invention relates to low pressure delivery systems for cryogenic liquids, and discloses a system wherein the delivery of a single-phase liquid is accomplished by gravity.

One application to which the present invention is particularly suited is the injection of cryogenic liquids into aluminum cans. Aluminum is desirable, because of its relatively low cost, as a storage medium for food and beverages. However, except for aluminum cans which contain a carbonated liquid, creating significant pressure in the can, aluminum cans cannot be arranged in stacks. The weight of the stack literally crushes the cans near the bottom of the stack.

One way of compensating for the inherent weakness of aluminum cans is to inject a small amount of a cryogenic liquid into the can before the can is sealed. As soon as the cryogenic liquid is introduced into the can, the liquid vaporizes. Because the volume of a cryogen in the gaseous phase is several hundred times the volume occupied by the corresponding liquid, there is a substantial pressure buildup inside the can, which enables the can to withstand strong external pressures.

The apparatus used to fill aluminum cans with cryogenic liquids must be able to process a large number of cans in a very short time. The filling of such cans must be done by machine, and the machinery is designed to handle precisely measured, small amounts of cryogenic liquid. It is therefore necessary to provide the cryogenic liquid at a precisely-controlled low pressure. Any error in the pressure of the liquid becomes greatly magnified when the liquid vaporizes, because of the large expansion factor.

Cryogenic liquids are typically stored in cylinders at very high pressures, of the order of 25 psi, or even 100 psi. It is one object of the present invention to withdraw a cryogenic liquid from such a high-pressure source, and to deliver the liquid at a precisely-controlled low pressure. Although the invention has been described with reference to the art of filling aluminum cans, it is understood that the invention can be used in any other context requiring delivery of cryogenic liquids at controlled low pressures.

Various methods have been known for producing a stream of cryogenic liquids. One example is shown is U.S. Pat. No. 4,059,424. The latter patent provides apparatus for controlled supply of cryogenic liquids, the apparatus including a separate phase-separator, in addition to the main container. Another example is U.S. Pat. No. 4,192,147, which shows another cryogenic liquid delivery system wherein the liquid is withdrawn from the bottom of a container.

The present invention accomplishes the object of providing a stream of cryogenic liquid, at a controlled low pressure, in a manner which is efficient and inexpensive. The present invention does not require the use of a separate phase separator. The invention yields a substantially single-phase liquid which is ready for immediate use.

SUMMARY OF THE INVENTION

The present invention comprises an insulated container into which a liquid cryogen is directed. The liquid cryogen, being stored in a cylinder or other storage means at a very high pressure, is passed through a pressure reducing valve before entering the container. The pressure reducing valve reduces the liquid pressure by about an order of magnitude, or more.

The liquid cryogen is introduced into the container through an insulated conduit, the conduit being connected to a float valve assembly inside the container. The float valve assembly maintains the liquid level in the container by initiating the refilling of the container when necessary. Part of the inlet conduit comprises a pipe which extends through an insulated sleeve, the sleeve being slidable through an opening in the lid of the container. The position of the sleeve is finely adjustable, so that the length of pipe which extends into the container may be varied by small, measured amounts. This variation in the overall length of the conduit changes the vertical position of the float valve.

Liquid cryogen is withdrawn from the container through a discharge conduit connected to the bottom of the container. The liquid flows out of the container by gravity. The pressure of the liquid depends on the vertical distance between the delivery point and the level of the liquid in the container. Thus, a fine adjustment of the position of the float valve causes a small change in the pressure of the output liquid stream.

If gas bubbles form in the liquid in the container, because of heat leaks or other causes, the bubbles tend to rise to the upper regions within the container. Therefore, the liquid withdrawn from the bottom of the container is of substantially a single phase, i.e. a liquid.

It is therefore an object of the invention to provide an apparatus for delivery of cryogenic liquids at precisely-controlled low pressures.

It is a further object of the invention to provide apparatus as described above, wherein the apparatus can work from a source of cryogenic liquid at very high pressure, to produce a stream of cryogenic liquid at low pressure.

It is a further object of the invention to provide apparatus as described above, wherein the liquid is withdrawn by gravity from the bottom of a container, in essentially a single phase.

It is a further object of the invention to provide apparatus as described above, the apparatus being simple and economical.

It is a further object of the invention to provide a method of delivering a stream of cryogenic liquid at a precisely-controlled low pressure.

Other objects and advantages of the invention will be apparent to those skilled in the art, from a reading of the following brief description of the drawing, the detailed description of the invention, and the appended claims.

BRIEF DESCRIPTION OF THE DRAWING

The FIGURE is a schematic diagram of the delivery system of the present invention, showing the container, float valve assembly, and inlet and outlet conduits, together with representations of the other components.

DETAILED DESCRIPTION OF THE INVENTION

Although the present invention will be described with reference to liquid nitrogen, it is understood that any other cryogenic liquid can be used.

Liquid nitrogen enters the system through conduit 1. The liquid nitrogen is taken from a storage means (not shown) where the nitrogen is held at a very high pressure, which could be 25 psig, or even 100 psig, or higher. The nitrogen then passes through pressure reducing valve 3. Valve 3 is a cryogenic valve, i.e. a valve capable of handling cryogenic liquids. Valve 3 reduces the pressure of the liquid by at least an order of magnitude.

Filling valve 5 is also a cryogenic valve, and is normally closed. Valve 5 is used to bypass pressure reducing valve 3 when the system is initially filled.

The liquid nitrogen passes through insulated flexible conduit 7. Conduit 7 can be insulated with foam rubber, or with another suitable insulating material. In one embodiment, conduit 7 is connected to pipe 8, which is mounted within adjustable sleeve 9. In this embodiment pipe 8 and sleeve 9 comprise coaxial cylinders, the space between the cylinders being evacuated. Sleeve 9 thus provides vacuum insulation for pipe 8 extending therethrough. The sleeve is slidable through an opening in lid 15 of container 13. Pipe 8 and conduit 7 thus define a continuous path for fluid, and are therefore illustrated schematically as one continuous line.

In another embodiment, conduit 7 is connected directly to sleeve 9, and there is no separate coaxial cylinder corresponding to pipe 8. In this embodiment, the outside diameter of conduit 7 matches that of sleeve 9. In both embodiments, sleeve 9 is slidable through an opening in lid 15 of container 13.

The incoming liquid is directed to float valve 21, disposed within container 13. In the embodiment having coaxial pipe 8, the pipe may protrude a short distance beyond the lower end of sleeve 9, for ease of connection to valve 21. In the embodiment wherein pipe 8 is eliminated, the sleeve 9 can be connected directly, or through a suitable intermediate fitting, to the valve. Float valve 21 operates with float ball 23 to regulate the amount of liquid in the container. Valve 21 is a proportional valve. That is, it allows liquid to flow into the container at varying rates, depending on the displacement of the float ball 23 from its neutral position.

Float valve 21 maintains the liquid 11 at a given level, the remainder of the space within the container comprising gas head 30. The level of the liquid 11 is precisely controlled, as will be explained below. A vent line 17 is provided to relieve excess pressure in the gas head 30.

Liquid nitrogen is withdrawn through outlet conduit 19, at the bottom of container 13. The pressure of the output liquid is determined by the distance between the lower end of conduit 19 and the liquid level in container 13. This distance, designated by the label "Measured Line" in the Figure, is carefully regulated by maintaining the liquid level at precisely the desired point.

The liquid level in container 13 is maintained by adjusting the sleeve 9, thereby changing the amount by which the sleeve extends into the interior of container 13. Making this adjustment controls the vertical position of float valve 21, which establishes a new equilibrium point for the liquid level. The flexible nature of conduit 7 accommodates the movement of sleeve 9.

The embodiment wherein sleeve 9 is vacuum insulated has the advantage that the sleeve is less likely to freeze during operation, and can therefore be adjusted repeatedly, without the need to defrost the apparatus. The embodiment wherein conduit 7 is directly connected to sleeve 9 (without the use of separate coaxial pipe 8) is less expensive to build. The latter embodiment is entirely satisfactory in environments wherein one does not need to make frequent adjustments in the output pressure, and wherein icing of the sleeve is therefore not a serious concern. The embodiment used therefore depends on the specific environment in which the system will operate.

Because the liquid is withdrawn from the bottom of the container, any gas bubbles that may form in the liquid tend to rise to the upper region of the container, and to become part of gas head 30. The output of the system is therefore maintained as a single-phase cryogenic liquid.

The output liquid flows by gravity out of the system. The present invention is intended for use in applications wherein the delivery system is located near the point at which the liquid is to be used. If there is a long distance between the delivery system and the machinery which requires the cryogenic liquid, additional phase separation apparatus may be needed.

It is apparent that the objects of the invention are fulfilled by the above disclosure. It is understood, however, that the invention may be varied in various ways. A means of maintaining the liquid level within the container, other than a float valve, may be used, for example. The specific structure chosen for the adjustable sleeve may also be changed. Different means of constructing and insulating the conduits and pipes can be used. Also, as stated above, the invention can be used with any cryogenic liquid, and is not limited to nitrogen. These and other similar modifications are to be deemed within the spirit and scope of the following claims.

What is claimed is:

1. Apparatus for delivering cryogenic liquids at controlled low pressures, comprising:

(a) container means, adapted for storing a cryogenic liquid, the container means having an insulated wall, (b) inlet conduit means for introducing cryogenic liquids into the container means, the inlet conduit means having an interior portion and a flexible exterior portion, the inlet conduit means extending through an adjustable sleeve means mounted in the wall of the container means, wherein the length of the interior portion of the inlet conduit means can be adjusted by varying the position of the sleeve means, (c) a float ball and float valve assembly, disposed within the container means, for regulating the height of the liquid within the container means, the float ball and valve being connected to the inlet conduit means, and (d) outlet conduit means, the outlet conduit means being disposed at the bottom of the container means, wherein liquid can flow by gravity out of the container means.

2. The apparatus of claim 1, wherein the float valve assembly includes a proportional valve adapted to allow liquid to enter the container means at varying rates of flow.

3. The apparatus of claim 2, further comprising a vent means communicating with the region above the liquid, within the container means.

4. The apparatus of claim 1, wherein the sleeve comprises an evacuated cylindrical member, the sleeve being slidable through an opening in the container means.

5. The apparatus of claim 1, wherein the inlet conduit means is directly connected to the sleeve, the diameter of the inlet conduit means being substantially equal to the diameter of the sleeve.

6. Apparatus for delivering a stream of cryogenic liquid from a high-pressure source to a point of use, at a precisely-controlled low pressure, comprising:

(a) an insulated container having a lid, (b) an inlet conduit adapted to conduct the cryogenic liquid from the source into the container, the inlet conduit having a pressure reducing valve, at least a portion of the conduit between the pressure reducing valve and the container being flexible, the inlet conduit extending into the container through an adjustable sleeve mounted in the lid of the container, (c) a float ball and valve assembly for regulating the liquid level within the container, the float ball and valve assembly being connected to the portion of the conduit extending into the container, the vertical position of the float ball and valve being variable according to the vertical position of the adjustable sleeve, the float ball and valve being adapted to control the flow of liquid from the conduit into the container, and (d) outlet conduit means disposed near the bottom of the container.

7. The apparatus of claim 6, wherein the sleeve comprises an evacuated cylindrical member, the sleeve being slidable through an opening in the lid of the container.

8. The apparatus of claim 6, wherein the inlet conduit is directly connected to the sleeve.

9. The apparatus of claim 8, wherein the float valve is a proportional valve.

10. The apparatus of claim 9 further comprising bypass valve means, adapted to provide a path for cryogenic liquid around the pressure reducing valve.

11. A method for delivering a cryogenic liquid from a high-pressure source, at a controlled low pressure, comprising the steps of:

(a) directing a stream of cryogenic liquid through a conduit and into a container, the conduit being attached to a float ball and valve assembly, (b) adjusting the level of the liquid in the container by varying the length of the portion of the conduit extending into the container, thereby varying the vertical position of the float ball and valve assembly, and (c) withdrawing liquid, by gravity, from the bottom of the container.

12. The method of claim 11, wherein the directing step is preceded by the step of passing the liquid through a pressure reduction means.

* * * * *